United States Patent [19]

Pedersen

[11] Patent Number: 4,884,833

[45] Date of Patent: Dec. 5, 1989

[54] LOCKING DEVICE

[76] Inventor: Palle Pedersen, Soester Svenstrup, Byvej 5, 4130 Viby Sjaelland, Denmark

[21] Appl. No.: 251,879

[22] Filed: Sep. 30, 1988

[51] Int. Cl.[4] ..... B65D 33/34

[52] U.S. Cl. ..... 292/316; 292/201; 24/706.7; 24/707; 24/706.5; 24/704.1

[58] Field of Search ..... 292/306, 316, 342, 53, 292/49, 227, 318, 323, 327, 201; 24/706.7, 706.5, 704.1, 707

[56] References Cited

U.S. PATENT DOCUMENTS

| | | | |
|---|---|---|---|
| 1,054,431 | 2/1913 | Mangold | 24/706.7 |
| 1,190,362 | 7/1916 | Aanerud | 24/706.7 |
| 1,930,560 | 10/1933 | Keidel | 292/318 |
| 2,028,423 | 1/1936 | Upham | 292/327 X |
| 2,713,707 | 7/1955 | Libby | 292/306 X |
| 3,244,444 | 4/1966 | Bisbing | 292/306 |
| 4,156,302 | 5/1979 | Van Niel | 24/150 R |

FOREIGN PATENT DOCUMENTS

| | | |
|---|---|---|
| 148370 | 6/1985 | Denmark . |
| 149540 | 7/1986 | Denmark . |
| 2374712 | 8/1979 | France . |

*Primary Examiner*—Richard E. Moore

*Attorney, Agent, or Firm*—Watson, Cole, Grindle & Watson

[57] ABSTRACT

A locking device of the type, which preferably is intended for releasable attaching a plastic wafer to goods providing security against the theft thereof, comprises a locking mechanism mounted in a house (3). which is intended to be attached to the wafer, and a pin (2), which is intended to cooperate with the locking mechanism. To produce such a locking device, which prevent damage of the article, through which the pin passes, and which gives sufficient resistance against removal of the pin, and which is simple to make with better security against non-authorized release, the locking device is characterized in that the locking mechanism comprises two locking plates (6*a*,6*b*) each having a long side (11*a*,11*b*) adjacent each other, each adjacent long side is provided with a centrally placed recess (12*a*,12*b*) for engagement with the shaft (8) of the pin (2). Furthermore, an inner house part (5) provides inclined planes (16*a*,16*b*) directed symmetrical against the center line of the house, separation means in the form of flaps (17) provided at the center line of the house and shaped to separate the locking plates (6*a*,6*b*), when these abut against the inclined planes (16*a*,16*b*) in their position for release of the pin (2). Moreover, the locking mechanism comprises spring means (7) biasing the locking plates (6*a*,6*b*) against their position for locking the pin.

A preferred embodiment for the locking device comprises a resilient airtight membrane (20), which is placed immediate above the locking plates (6*a*,6*b*). Hereby, a non-authorized release of the pin will be particularly difficult.

10 Claims, 2 Drawing Sheets

LOCKING DEVICE

BACKGROUND OF THE INVENTION

The present invention relates to a locking device, preferably for releasable attaching a plastic wafer to articles providing security against the theft thereof and which device comprises a locking mechanism mounted in a house and intended to be attached to the wafer, and a pin member, preferably with a smooth surface, interacting with the locking mechanism.

Several types of locking devices are known which are intended for a temporarily but secure fixing of plastic wafers containing electronic detection circuits to the article which is to be secured against theft.

The locking mechanism of the locking device is contained in a house which is arranged in the plastic wafer, and this assembly is placed at one side of the article to be protected, after which a so-called pin is passed through the article and into the locking mechanism. The enlarged head of the pin placed at one side of the article together with the plastic wafer/locking mechanism assembly placed at the other side of the article hereby will prevent that the article is brougth out of a store or another especially protected area herein, as the electronic circuit in the plastic wafer by passing particular monitoring antennas will actuate an alarm system. In case the article has been purchased authorized personnel having a particular release device will release the connection between the pin and the locking mechanism and remove the pin so that the wafer may be removed from the article.

In such known locking devices the shaft of the pin is provided with circumferentially extending grooves at spaced positions. These grooves are intended for interlocking of the pin and the locking mechanism, and they are to be made with a very high accuracy of machining to obtain a secure interlocking. Moreover, the presence of the grooves in the shaft may give rise to destruction of a textile web as the shaft passes therethrough either by rupture of threads or by pulling out threads. This occurs especially in case with finely woven articles.

To prevent these drawbacks more locking devices are made wherein the cooperating pin member is provided with a smooth surface. However, these locking devices may be released by a mechanic action possibly by means of a specially provided tool and, accordingly, they are not well suited for securing goods against theft as it is relatively easy to make a non-authorized release of the locking mechanism.

Other locking devices with a smooth shaft are provided with spring biased balls or rollers which wedge the pin either by wedging between more balls or between a roller and a wall of the house. These locking devices may be released by magnetism in that the balls, a holder for the balls or the roller are made of a magnetic material.

However, these locking devices are complex and costly to make for having a satisfactory operation and a sufficient resistance against removal of the pin. Accordingly, a very high accuracy is required for machining of constituents.

SUMMARY OF THE INVENTION

It is the object of the invention to remedy the above mentioned drawbacks and to provide a locking device which gives a high hold force and which is simple to make and which gives better security against non-authorized release than locking devices known till now.

With this object in view the locking device according to the invention is characterized in that the locking mechanism comprises two locking plates each having a long side adjacent each other, each adjacent long side is provided with a centrally placed recess for engagement with the shaft of the pin, a part of the house providing inclined planes directed symmetrical against the centre line of the house, separation means provided at the centre line of the house and shaped to separate the locking plates, when these abut against the inclined planes in their position for release of the pin, and spring means biasing the locking plates against their position for locking of the pin. The house may easily be manufactured by casting of a suitable metal or plastic material, and the two locking plates may be manufactured, simply by punching. At the manufacturing it should be ensured that the recesses of the locking plates together form an opening with such a size that they are able to squeeze the shaft.

This locking device will give a high security against non-authorized release in that it will only be possible to release the locking device with a non-mechanical acting apparatus, e.g. a magnetic or pneumatic apparatus as explained in greater detail later. Experiments made with locking devices according to the present invention have shown that a simple withdrawal of the pin is impossible in that the force required for withdrawal of the pin from the locking mechanism induces a load substantially corresponding to the breaking load of the pin.

DESCRIPTION OF THE PREFERRED EMBODIMENTS

Figure 1:
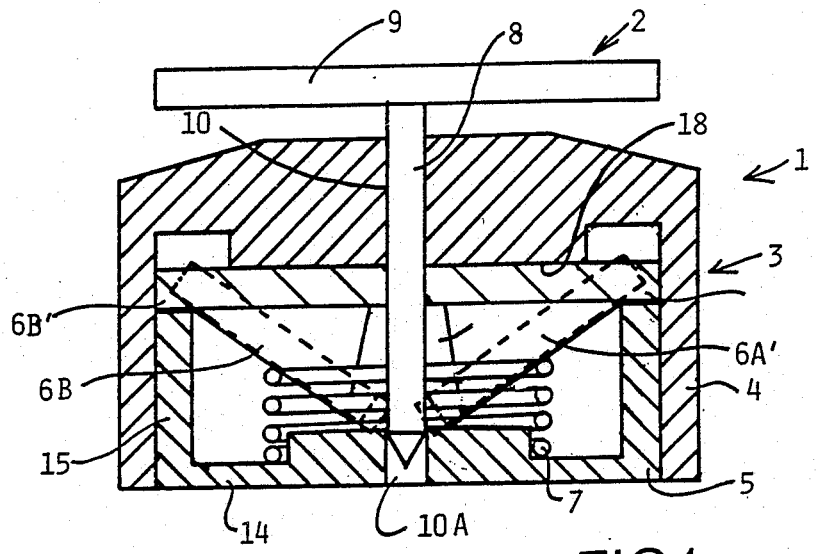
FIG. 1 is a schematic section through a locking device according to an embodiment of the invention.

FIG. 1 shows a locking device generally indicated with the reference number 1 and intended for use in connection with releasable attaching of plastic wafers (not shown) to articles providing a security against the theft of the connected articles.

The locking device comprises a pin 2, a substantially cylindrical house 3, which is made of plastic or metal and which consists of an outer house part 4 and an inner house part 5, two locking plates *6a, 6b* each provided in form of a substantially half-circular plate made of a magnetic material, preferably hardened steel, and spring means in the form of a spiral spring 7.

The locking device of FIG. 1 is intended to magnetic activation for release of the engagement between the pin 2 and the locking plates *6a, 6b*. The pin 2 is advantageously made with a smooth shaft 8 and a relatively large head 9 for engagement with the article to be protected against theft. With such a construction of the pin very little damage of the article occurs.

In the outer house part, the house 3 is provided with an insertion opening 10 for inserting of the shaft 8 into the house 3 for interlocking therewith. The shaft 8 passes through the house and out through an opening 10*a* in the inner house part 5. The opening 10*a* in the inner house part 5 may be omitted, however, the opening is advantageous, in that it is possible to use pins 2 with a longer shaft, whereby it is possible to protect articles of different thickness.

The outer house part 4 and the inner house part 5 are interconnected by whichever known means not allowing an immediate disconnection, e.g. welding, deforming of the interfaces e.t.c.

Figure 2:
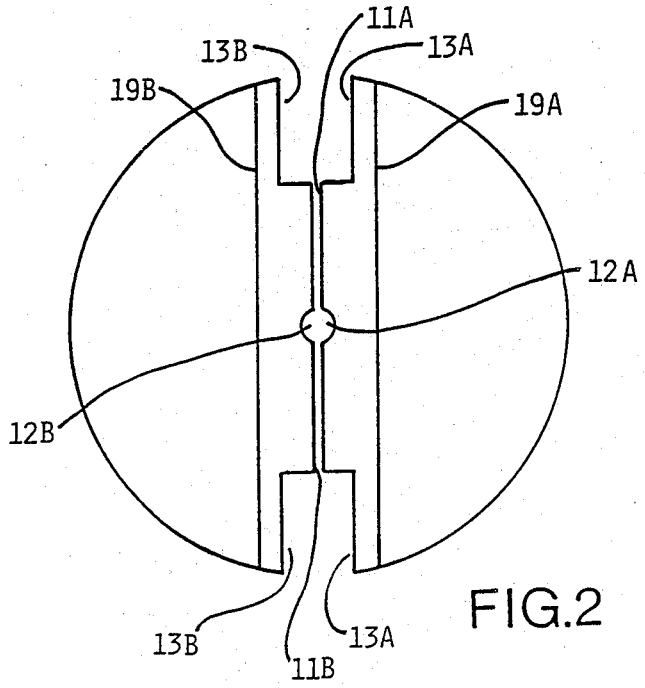
FIG. 2 is a plan view of two locking plates seen from above.

As clearly illustrated in FIG. 2 each locking plate 6*a*,6*b* consists of a substantially flat half-circular plate having a long side 11*a*,11*b* adjacent the corresponding long side 11*b*,11*a* of the other of the locking plates. In each adjacent long side a recess is provided at a central position in the form of a substantially half-circular opening 12*a*,12*b*, the diameter of which substantially corresponds to the diameter of the shaft 8 intended to cooperate with these locking plates 6*a*,6*b*.

The locking plates 6*a*,6*b* are made of a circular plate or disc with a diameter substantially corresponding to the inner diameter of the outer house part 4. This plate or disc is provided with a central circular opening with a diameter corresponding to the diameter of the shaft 8. Then the disc is divided along a diameter in such a way, that the two substantially half-circular openings 12*a*,12*b* produced hereby, when the two long sides of the locking plates are placed abutting each other, will provide a section, which is slightly smaller than the section of the shaft 8. Hereby a very solid engagement between the shaft 8 and the locking plates may be obtained.

Moreover, each locking plate may along its long side be chamfered at the top side facing the outer house part 4. Hereby an edge 19*a*,19*b* is obtained which substantially is parallel with the long side 11*a*,11*b*, and the importance of this edge will be explained hereinafter.

It is obvious, that the central recesses may be provided with a form different from the circular form. However, it is to be ensured that the two central recesses together will form a section which is slightly smaller than the section of the shaft 8 of the pin 2 used.

A recess 13*a*,13*b* is provided at each end of the long side of a locking plate. This recess is intended to cooperate with separation means (explained hereinafter) placed on the inner house part 5 to provide a secure release of the engagement between the shaft 8 and the central recesses 12*a*,12*b* in the locking plates.

The inner house part 5 has an outer diameter substantially corresponding to the inner diameter of the outer house part 4, so that the inner house part may be placed in the outer house part with a loose fit. The inner house part 5 is made as a cylindrical wall 15 provided with a bottom 14. An inwardly protruding part 14*a*, provided inte- grally with the bottom 14, is designed for guiding the spring 7.

By recessing of material in the cylindrical wall two inclined planes 16*a*,16*b* are formed symmetrical against the centre line of the house, and separation means 17 are provided at the centre line of the house in the form of two vertical flaps 17 converging upwardly and cooperating with the recesses 13*a*,13*b* for releasing the pin 2 by separating the locking plates 6*a*,6b, when these are forced downwardly by means of a magnet.

In the operative condition the shaft 8 of the pin will be in engagement with the locking plates, which are in the position indicated with 6*a*' and 6*b*'. The spring 7 bias the locking plates against this position. In this position the locking plates 6*a*,6*b* substantially are perpendicular to the shaft 8 of the pin and abut against a downwardly facing flat plane 18 of the outer house part 4. Hereby a solid engagement between the shaft 8 of the pin and the locking plates 6*a*,6*b* may be obtained, which shaft is made of a more soft metal than that of the locking plates. At a non-authorized attempt to remove the pin, the locking plates are tilted, and hereby the bottom edges of the openings 12*a*,12*b* will come into engagement with the shaft 8 of the pin. This tilting takes place in a secure way along the edges 19*a*,19*b*, provided that the locking plates are chamfered. By further outwardly drawing in the pin the locking plates more powerful squeeze the shaft 8 and prevent the withdrawal of the pin 2 from the house.

Provided the adjacent planes between the house and the wafer provide a very small friction, a non-authorized release will be made more difficult, as a possible attempt to "unscrew" the pin 2 is impossible, as the house 3 rotates together with the pin 2.

In the condition where a magnet is placed under the house 3, the magnet pulls the locking plates to the position indicated with 6*a*,6*b* against the effect from the spring 7.

As the locking plates are moved downwardly, they will be moved apart from each other due to the inclination of the vertical flaps 17, whereby a secure release of the engagement between the shaft 8 and the locking plates 6*a*,6*b* is obtained. In a secure way the locking plates 6*a*,6*b*, abutting against the inclined planes 16*a*, 16*b*, will be separated from each other and the pin 2 may be withdrawed from the house, so that the wafer may be released from the article.

Figure 3:
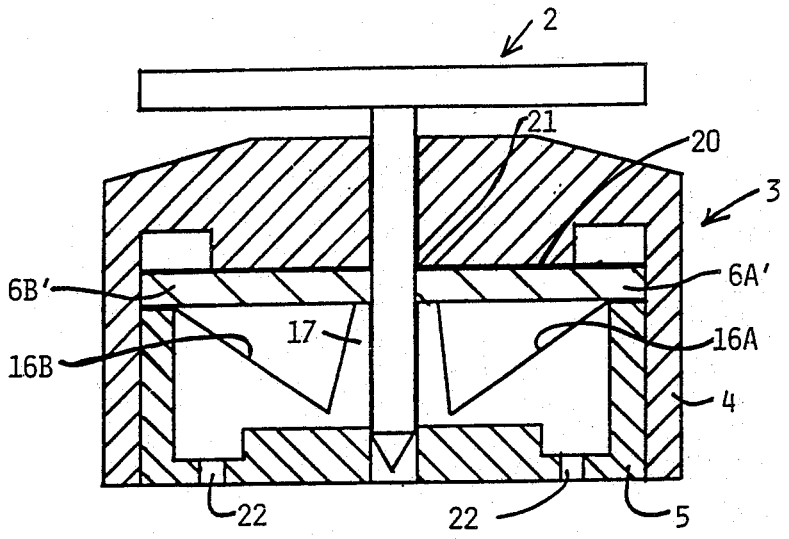
FIG. 3 is a schematic section, corresponding to FIG. 1, through a locking device according to a further embodiment of the invention.

FIG. 3 shows a further embodiment of the locking device according to the invention. This locking device is intended for pneumatic activation by inducing of a vacuum to the interior of the house 3 so as to release the connection between the shaft 8 and the locking mechanism. As it is substantially impossible to bring along a vacuum source for causing a non-authorized release, a particularly secure locking device is hereby obtained.

This embodiment corresponds substantially to the one shown in FIG. 1, though the spring is not shown for clarity.

However this embodiment is different, in that a resilient airtight membrane 20 with a central opening 21 for the passage of the shaft 8 is placed immediately above the locking plates. In the bottom of the inner house part 5 one or more holes 22 are provided for inducing a vacuum to the interior of the house below the membrane/locking plate assembly 20,6*a*,6*b*. Hereby this assembly will be moved downward against the action of the spring in a way corresponding to the magnetic activation. Accordingly, the pin can be withdrawed from the house.

The holes 22 are provided in any specific pattern to impede a non-authorized inducing of vacuum.

Figure 4:
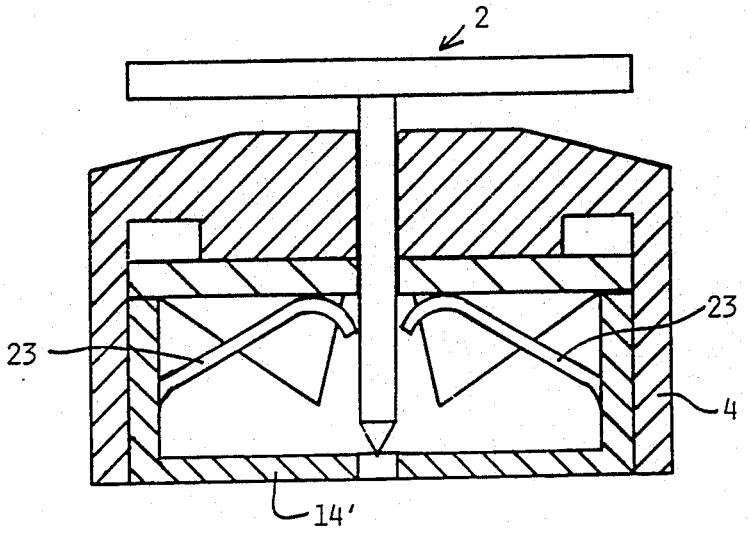
FIG. 4 is a schematic section, corresponding to FIG. 1, through a further embodiment of the invention.

FIG. 4 shows a further embodiment, wherein the house preferably is made of plastic, and wherein the spring means are made of resilient flaps 23, which are made integrally with the inner house part 4. This locking device is shown for magnetic activation, but may as well be constructed for pneumatic activation. In this embodiment the bottom 14' of the inner house part 4 is made with a substantially flat configuration.

I claim:

1. Locking device, preferably for releasable attaching a plastic wafer to articles providing security against the theft thereof and which device comprises a locking mechanism mounted in a house and intended to be attached to the wafer, and a pin member, preferably with a smooth surface, interacting with the locking mechanism characterized in that the locking mechanism comprises two locking plates (6a,6b) each having a long side (11a,11b) adjacent each other, each adjacent long side is provided with a centrally placed recess (12a,12b) for engagement with the shaft (8) of the pin (2), an inner house part (5) providing inclined planes (16a,16b) directed symmetrical against the centre line of the house, separation means (17) provided at the centre line of the house and shaped to separate the locking plates (6a,6b), when these abut against the inclined planes (16a,16b) in their position (6a,6b) for release of the pin (2), and spring means (7) biasing the locking plates against their position (6a,6b) for locking of the pin.

2. Locking device as claimed in claim 1, characterized in that the house (3) is substantially cylindrical.

3. Locking device as claimed in claim 1, characterized in that the locking plates are made of a magnetic material, preferably hardened steel.

4. Locking device as claimed in claim 1, characterized in that a resilient airtight membrane (20) is placed immediately above the locking plates (6a,6b), and that holes (22) are provided through the house for inducting of a vacuum to the interior of the house below the membrane/locking plate assembly.

5. Locking device as claimed in claim 1, characterized in that a recess (13a,13b), cooperating with an associated separation means (17), is provided at each end of an adjacent side of a locking plate.

6. Locking device as claimed in claim 1, characterized in that the two central recesses (12a,12b) with the locking plates (6a,6b) provided at the same level and with the sides (11a,11b) adjacent to each other, together form an opening with a section, which is slightly smaller than the section of the shaft of the pin.

7. Locking device as claimed in claim 1, characterized in that each of the central recesses (12a,12b) are provided in the form of a sector of a circle, which is slightly smaller than a half-circle.

8. Locking device as claimed in claim 2, characterized in that the adjacent planes between a house and a wafer provide a very small friction.

9. Locking device as claimed in claim 1, characterized in that each locking plate (6a,6b) along its long side (11a,11b) is chamfered at the top side for obtaining an edge (19a,19b), which substantially is parallel with the long side (11a,11b).

10. Locking devices as claimed in claim 4, characterized in that the holes (22) are provided in a specific pattern.

* * * * *